US006945794B1

(12) United States Patent
Yang et al.

(10) Patent No.: US 6,945,794 B1
(45) Date of Patent: Sep. 20, 2005

(54) LGA CONTACT WITH EXTENDED ARM FOR IC CONNECTOR

(75) Inventors: ZhenQi Yang, Kunsan (CN); FuJin Peng, Kunsan (CN); Wen He, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/066,948

(22) Filed: Feb. 25, 2005

(30) Foreign Application Priority Data

Feb. 27, 2004 (TW) ..... 93105067

(51) Int. Cl.[7] ..... H01R 12/00
(52) U.S. Cl. ..... 439/73; 439/331
(58) Field of Search ..... 439/73, 331

(56) References Cited

U.S. PATENT DOCUMENTS 5,127,837 A * 7/1992 Shah et al. ..... 439/71
5,576,937 A * 11/1996 Kubo ..... 361/820
5,741,141 A * 4/1998 O'Malley ..... 439/73
6,206,715 B1 3/2001 Liu et al.
6,425,768 B1 * 7/2002 Taylor ..... 439/67
6,488,522 B2 * 12/2002 Fukunaga ..... 439/331
6,722,916 B2 * 4/2004 Buccinna et al. ..... 439/500

* cited by examiner

*Primary Examiner*—Tho D. Ta
(74) *Attorney, Agent, or Firm*—Wei Te Chung

(57) ABSTRACT

A fastening mechanism for an LGA socket (40) mounted on a PCB (50) for nesting an IC package (30) includes at least one holding unit (60) having a base portion (602) connected with the PCB, a resilient arm (604) extended from the base and formed with a pressing head (606). The head is formed with an compressing face (6060) able to be adjusted to move in a direction vertical to the PCB and rotate round an axis vertical to the PCB to hold the IC package on the LGA socket, thereby establishing electrical engagement between the IC package and the LGA socket. With this arrangement, good position of the IC package on the LGA socket is assured and a relatively higher space over the LGA socket can be saved to arrange other components or operate adjacent components.

18 Claims, 8 Drawing Sheets

LGA CONTACT WITH EXTENDED ARM FOR IC CONNECTOR

BACKGROUND OF THE INVENTION

1. Field of the Invention

The instant invention is related to the art of connectors, and more particularly to a positioning mechanism adapted to hold an integrated circuit (IC) package, e.g. a land grid array (LGA) package, on a socket mounted on an electrical substrate, such as a printed circuit board (PCB).

2. Description of the Prior Art

With the development of electrical components on an electrical substrate, e.g. a PCB, toward miniaturization, multifunction and high integration, it becomes more and more concerned to secure position relationships between the electrical components, and to decrease real estate that each component occupies on the PCB as possible as specific conditions permit.

LGA sockets of old style have the problems mentioned above. Referring to FIGS. 9 and 10, a conventional LGA socket assembly 90 is shown, and comprises a dielectric housing 92 with a plurality of terminals 920 planted thereon, a metal stiffener 94 harnessed on the housing 92, an metal urging member 96 and a metal pressing member 98 attached to opposite sides of the metal stiffener 94. The urging member 96 has a shaft 960 rotatably secured on the metal stiffener 94 and a handle 962 extending perpendicularly from one distal end of the shaft 960.

In mounting the LGA socket assembly 90 on one side of a PCB in a re-flow procedure (not shown), solder balls provided to electrically bridge corresponding terminals and corresponding circuits on the PCB are melted and then cooled, thereby attaching the LGA socket assembly 90 on the PCB.

With this configuration of the LGA socket assembly 90, two main problems of the LGA socket assembly 90 stand out. First one, the stiffener 94, the urging member 96 and the pressing member 98 are made of metal. This results in a relatively heavy weight of the LGA socket assembly 90. Consequently, the LGA socket assembly 90 is prone to slant or fall off during a second re-flow procedure in which the PCB is reversed to facilitate soldering other components on the other side of the PCB.

Second one, in use, the handle 962 and the pressing member 98 are rotatable around the opposite sides of the stiffener in a space, respectively. The space is much higher than a total height of the LGA, even a total height of a top surface 930 of an IC package 93 with respect to the PCB. Differently put, relatively higher space needs to be provided above the LGA for rotating of the handle 962 and the pressing member 98. This is prone to bring un-convenience in assembling, disassembling or operating other components.

Accordingly, a new positioning mechanism, which overcomes the disadvantages pointed out above, is desired.

SUMMARY OF THE INVENTION

Accordingly, a main object of the invention is to provide a positioning mechanism for an LGA socket with ability to assure attaching the LGA socket on a PCB in a second re-flow and to dispose the LGA socket on the PCB in a relatively small space.

To fulfill the above object, a positioning mechanism for securing an IC package on an LGA socket arranged on a PCB is provided according to the present invention. The LGA socket comprises a dielectric housing of generally rectangular configuration and a plurality of terminals planted on the housing. The housing is formed with a top interface for supporting the IC package and a bottom interface adapted to be mounted on the PCB. The positioning mechanism comprises a positioning part being bound on the PCB, a resilient arm being connected with the positioning part and being formed with a pressing portion. When the IC package is placed on the housing, the pressing portion can be adjusted in a direction vertical to the PCB and a plane parallel to the PCB to, thereby holding the IC package on the housing.

With this positioning mechanism, an urging member, a pressing member and a stiffener made of metal material, as shown in FIGS. 9 and 10, are not necessary to be equipped on the LGA socket. As a result, in a second re-flow procedure, the housing can be more firmly attached to a back of the PCB. Good position of the LGA socket on the PCB is assured, thereby facilitating assuring secure and electrical bridging between the IC package and the PCB. Moreover, the positioning mechanism can be operated in a space little higher than the IC package having mounted on the housing. Further, without the urging member and the pressing member, a relatively higher space over the LGA socket can be used to arrange other components or operate adjacent components.

BRIEF DESCRIPTION OF THE DRAWINGS

The features of the present invention which are believed to novel are set forth with particularity in the appended claims. The invention, together with its objects and the advantages thereof, may be best understood by reference to the following detailed description taken in conjunction with the accompanying drawings, in which like reference numerals identify like elements and in which:

DESCRIPTION OF PREFERRED EMBODIMENTS OF THE INVENTION

Reference will now be made to the drawings to describe the present invention in detail.

Figure 1:
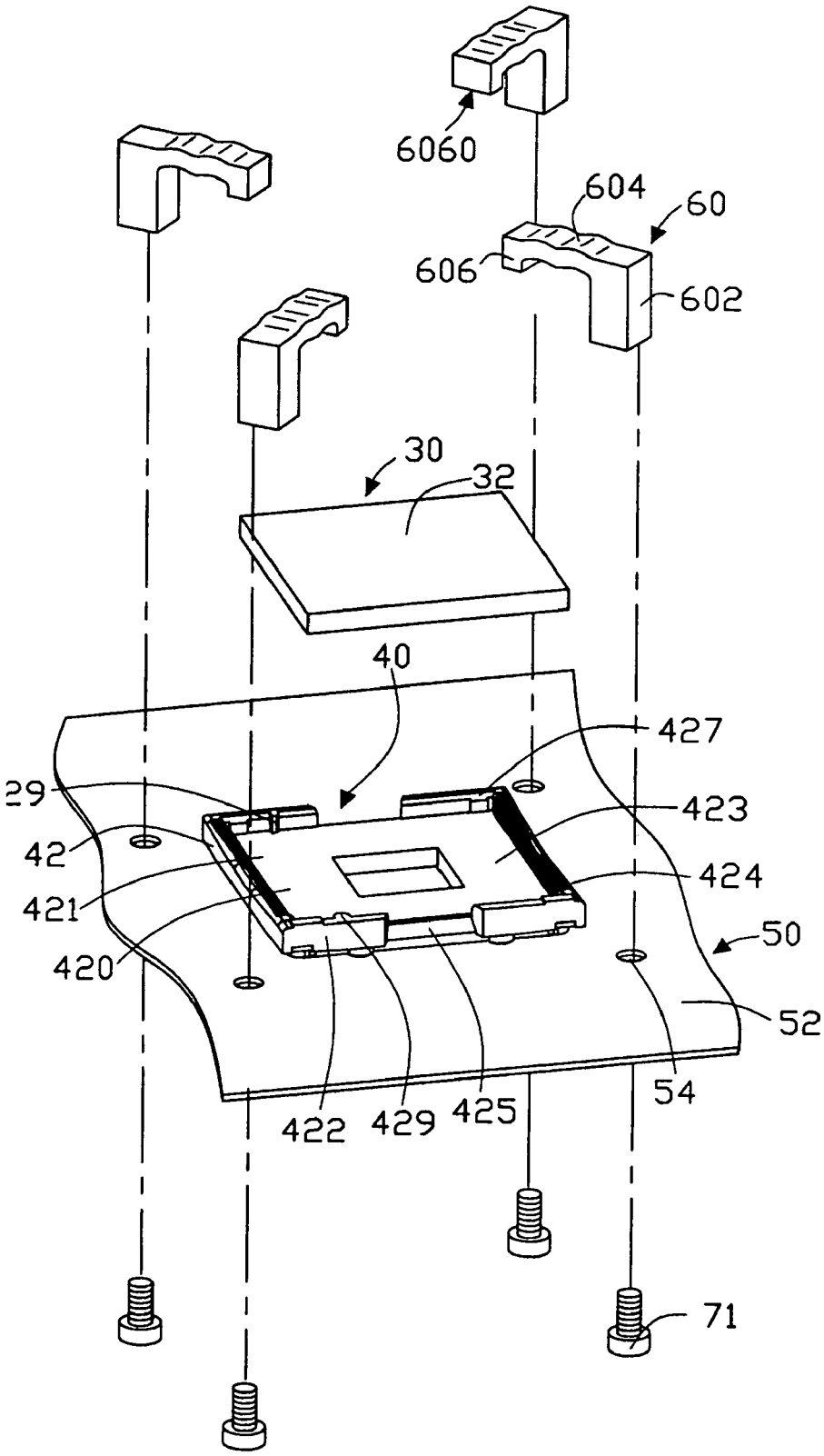
FIG. 1 is an exposed, isometric view of an LAG socket mounted on a PCB, together with a position mechanism according to a preferred embodiment of the present invention and an IC package ready to engage with the LGA socket.

Referring to FIG. 1, a first positioning mechanism is shown and mainly used to hold an IC package 30 on an LGA socket mounted on a top surface 52 of a PCB 50. The LGA socket 40 comprises a dielectric housing 42 and a plurality of terminals 44 planted on the housing 42.

The housing 42 has a bottom floor 420 of generally rectangular configuration and first and second pairs of side walls 422, 424 raised from four edges of the bottom floor 420. The bottom floor 420 and the side walls 422, 424 cooperatively defines a cavity 423 for receiving the IC package 30.

A recess 425 is defined in a middle of each of the first pair of side walls 422, for facilitating placing or removing the IC package 30 into or from the cavity 423.

Each side wall 422, 424 is formed with a slant surface 427 on a top inner corner thereof, the slant surface 427 being used to guide insertion of the IC package 30 into the cavity 423.

Three protrusions 429 are formed on inner sides of the first pair of side walls 422, for positioning the IC package 30 in the cavity 423.

The bottom floor 420 has a top surface 421 and a bottom surface (not labeled), and defines an array of passageways (not labeled) between the top surface 421 and the bottom surface.

Figure 2:
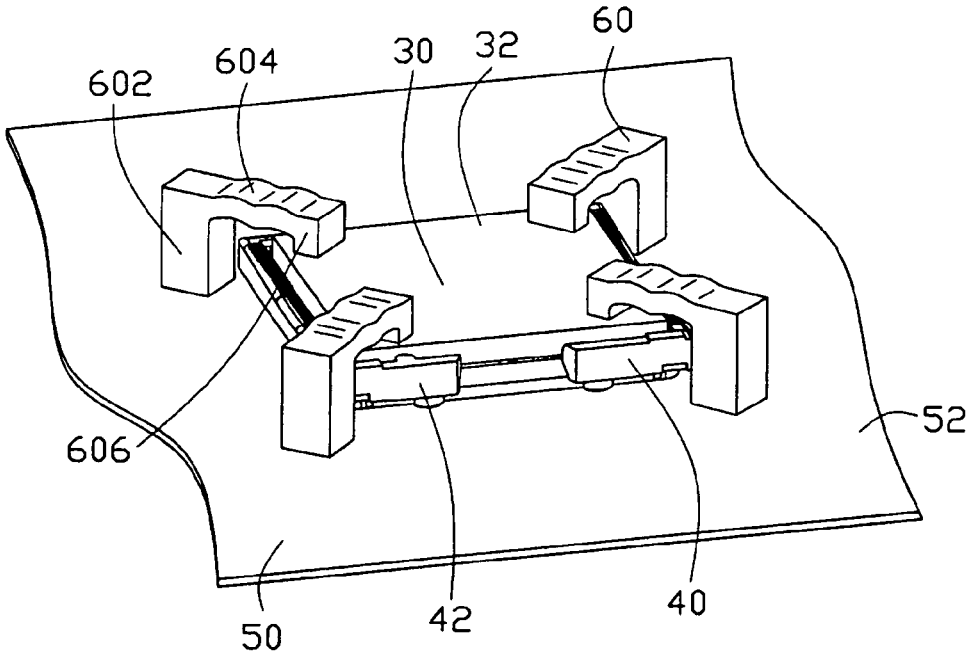
FIG. 2 is an assembled, isometric view of FIG. 1, with the positioning mechanism ready to hold the IC package.
Figure 3:
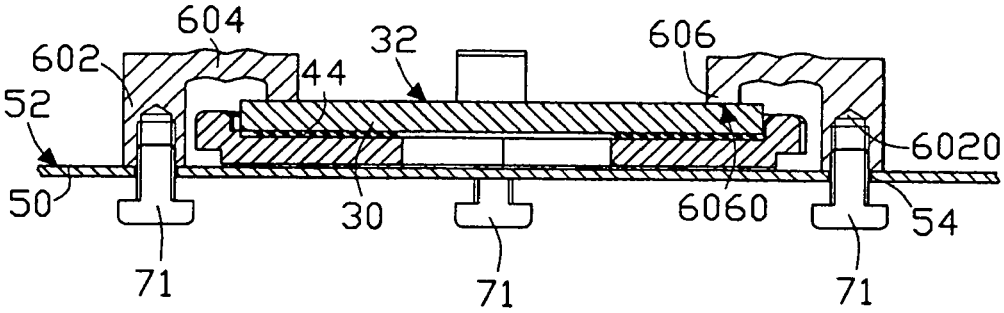
FIG. 3 is cross section view taken along a diagonal line of the LGA socket of FIG. 2.

Referring also FIGS. 2 and 3, in assembly, each terminal 44 is inserted into a corresponding passageway, with a top engaging part 440 extending beyond the top surface 421. A solder ball is soldered on a bottom end of each terminal 44 (not shown). After assembly, all the solder balls soldered on the terminals 44 of the LGA socket 40 are correspondingly soldered on corresponding circuit members pre-arranged on the PCB 50, thereby mounting the LGA socket 40 on the PCB 50.

In use, the IC package 30 is placed into the cavity 423 with guidance of the slant surface 427 of the side walls 422, 424. The three protrusions 429 cooperatively assure position of the IC package 30 in the cavity 423.

Figure 4:
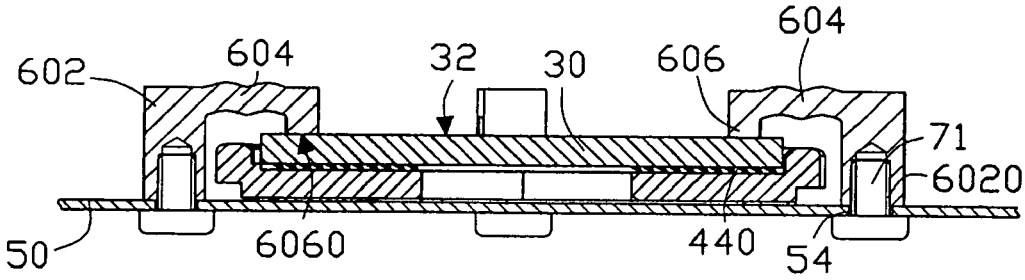
FIG. 4 is similar to FIG. 3, but showing the positioning mechanism holding the IC package on the LGA socket.

Referring to FIGS. 1, 3 and 4, in order to assure electrical seating of the IC package 30 on the engaging parts 440 of the LGA socket 40, a first positioning mechanism 60 is provided according to a first embodiment of the present invention.

The first positioning mechanism comprises four holding members 60 arranged near four corners of the housing 42, respectively.

Each holding member 60 has a post 602 of rectangular configuration fixed on the PCB 50, a resilient arm 604 extending from a top of the post 602 in a direction substantially parallel to the PCB 50. The resilient arm 604 is formed with a pressing section 606 extending toward the PCB 50. The pressing section 606 is formed with a compressing surface 6060 parallel to the PCB 50. To improve resilient characteristics of the resilient arm 604, the arm 604 can be shaped with a wave-like configuration or a curved configuration.

In the first embodiment, the post 602 defines a screw hole 6020 in a bottom surface thereof. A through hole 54 is defined in the PCB 50 little larger than the screw hole 6020, but smaller than the bottom surface in a cross section plane.

A screw 71 is provided to be inserted through the through hole 54 from a bottom of the PCB 50 and couples with the screw hole 6020 of the post 602. With this arrangement, the holding member 60 can freely move in a direction vertical to the top surface 52 of the PCB 50 by adjusting coupling depth of the screw 71 into the screw hole 6020, and rotate around an axis of the post 602 vertical to the top surface 52 of the PCB 50.

In use, the arms 604 of the four holding members 60 are turned outward from the housing 42 to the extend that the IC package 30 can be placed into the cavity 423 of the housing 42 with the guidance of the slant surfaces 427, the three protrusions 429 positioning the IC package 30 in the cavity 423.

After the IC package 30 is nested in the cavity 423, each screw 71 coupled with a corresponding holding member 60 is loosed to the extend that the holding member 60 can be lifted up and rotated to move the compressing surface 6060 of the holding member 60 over a top surface 32 of the IC package 30.

The screw 71 is tightened and the pressing section 606 is brought downward to compress the top surface 32 of the IC package 30 with the compressing surface 6060 thereof. When all the pressing sections 606 uniformly hold four corners of the top surface 32 of the IC package 30, respectively, secure and electrical engagement between the IC package 30 and the engaging parts 440 of all the terminals 44 of the LGA socket 40 is established.

With this configuration of the holding members 60, the holding member 60 can be adjusted to move in the direction vertical to the top surface 52 of the PCB 50 and rotate around the axis of the post vertical to the top surface 52. The holding members 60 can each be operated in a relatively small space little higher than a total height of the top surface 32 of the IC package 30 relative to the top surface 52 of the PCB 50. Additionally, the holding members 60 occupy a relatively little real estate on the PCB 50. Much space can be saved to be used for arrangement of other components or operating of adjacent components.

The configuration of the first positioning mechanism is detailedly illustrated in the first preferred embodiment of the present invention, but not limited thereto. The configuration of the first positioning mechanism may be various in light of different specific conditions under which the LGA socket 40 is used.

Figure 5:
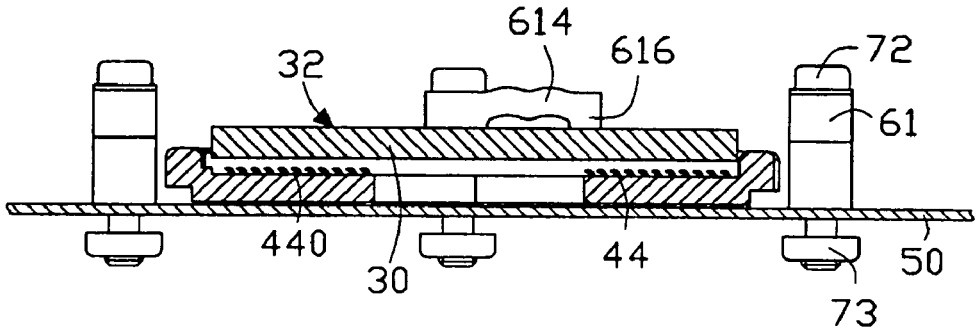
FIG. 5 is a cross section view taken along a diagonal line of the LGA socket mounted on the PCB, together with a second position mechanism according to a second preferred embodiment of the present invention and the IC package ready to engage with the LGA socket.
Figure 6:
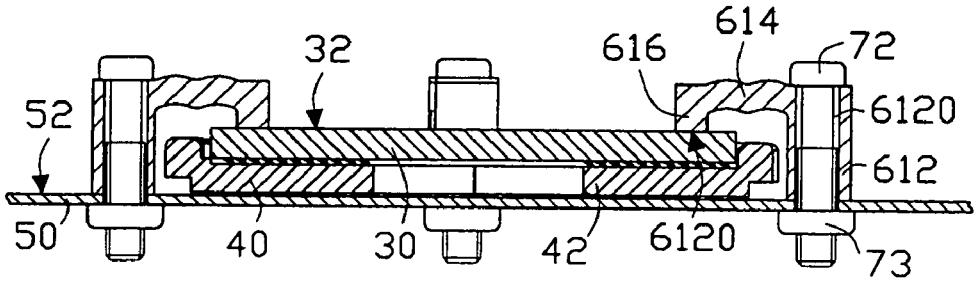
FIG. 6 is similar to FIG. 5, but showing the second positioning mechanism holding the IC package on the LGA socket.

Referring to FIGS. 5 and 6, together with the LGA socket 40, the PCB 50 and the IC package 30 of FIG. 1, in a second embodiment of the positioning mechanism of the present invention, the second positioning mechanism is much similar to the first positioning mechanism, with the exception of the way in which the holding member 61 is fixed on the PCB 50 and adjusted.

The holding member 61 of the second positioning mechanism has an outer configuration much similar to the holding member 60 of the first positioning mechanism, except the post 614 of the second positioning mechanism is defined a through channel 6120 instead of the screw hole 6020 of the first positioning mechanism.

A bolt 72 and a mating nut 73 are provided to cooperatively fulfill the same functions as the screw 71 and the screw hole 6020 perform in the first embodiment.

In assembly, the bolt 72 is inserted through the through channel 6120 and the through hole 54 of the PCB and couples with the nut 73.

With this configuration of the holding members 61 of the second positioning mechanism, the holding member 61 of the second positioning mechanism can also be adjusted to move in a direction vertical to the top surface 52 of the PCB 50 and rotate around an axis of the post 612 vertical to the PCB 50. The holding members 61 of the second positioning mechanism can each be operated in a relatively small space little higher than a total height of the top surface 32 of the IC package 30 relative to the top surface 52 of the PCB 50. Additionally, the holding members 61 of the second positioning mechanism occupy a relatively little real estate on the PCB 50. Much space can be saved to be used for arrangement of other components or operating of adjacent components.

In use, the arms 614 of the second positioning mechanism are turned outward from the housing 42 to the extend that the IC package 30 can be placed into the cavity 423 of the housing 42 with the guidance of the slant surfaces 427, the three protrusions 429 positioning the IC package 30 in the cavity 423.

After the IC package 30 is nested in the cavity 423, the bolt 72 is loosed from the nut 73 to the extend that the holding member 61 of the second positioning mechanism can be lifted up and rotated to move the compressing surface 6160 thereof over the top surface 32 of the IC package 30.

The bolt 72 is tightened with the nut 73 and the pressing section 616 of the second positioning mechanism is brought downward to compress the top surface 32 of the IC package 30 with the compressing surface 6160 thereof. When all the pressing sections 616 of the second positioning mechanism uniformly hold the top surface 32 of the IC package 30, secure and electrical engagement between the IC package 30 and the engaging parts 440 of all the terminals 44 of the LGA socket 40 is established.

Figure 7:
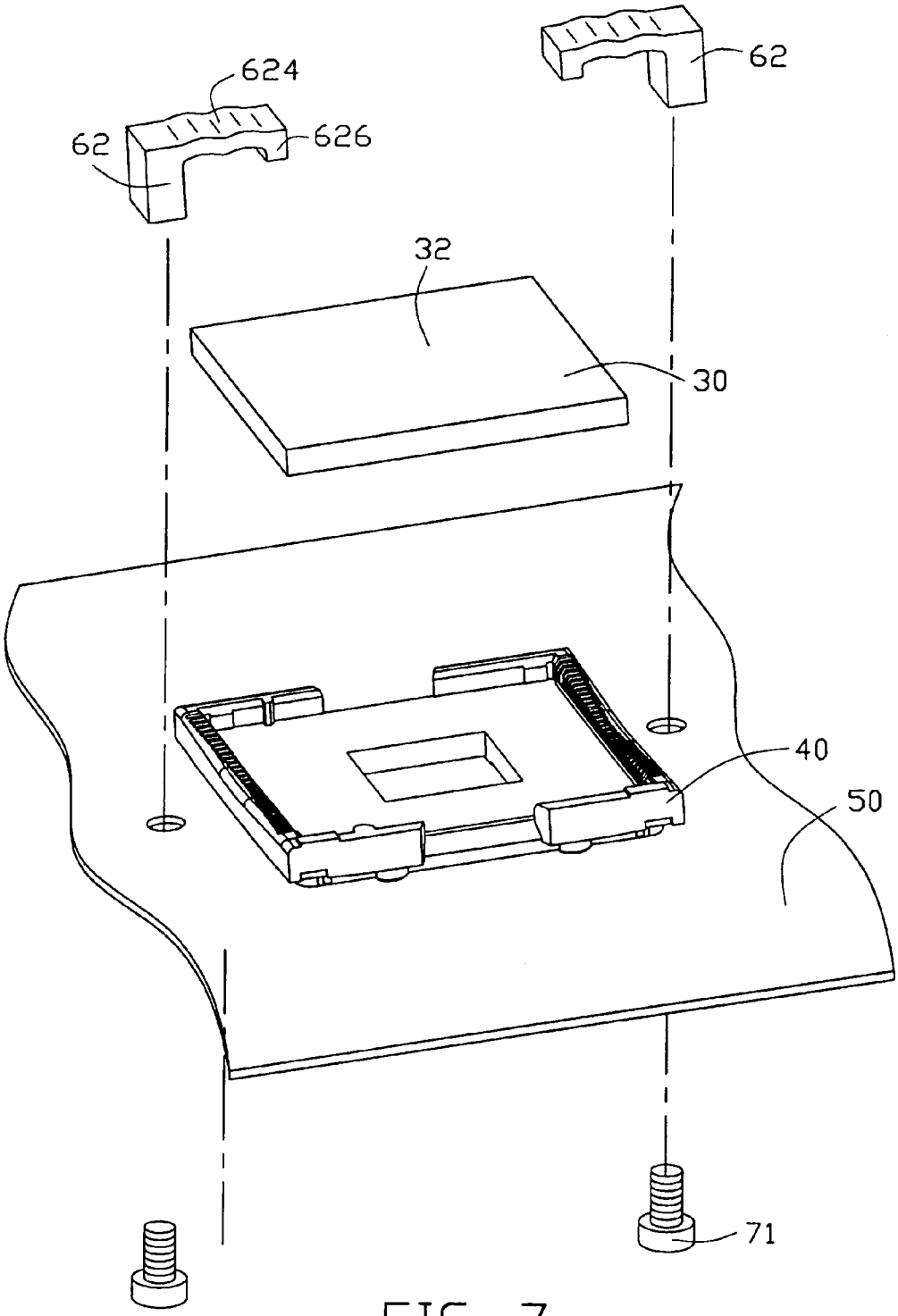
FIG. 7 is an exposed, isometric view of the LAG socket mounted on the PCB, together with a third position mechanism according to a third preferred embodiment of the present invention and the IC package ready to engage with the LGA socket.

Referring to FIG. 7, together with the LGA socket 40, the PCB 50 and the IC package 30 of FIG. 1, in a permitted conditions, only a pair of holding members 62 identical to that of the first positioning mechanism is provided in a third embodiment of the present invention to hold the IC package 30 on the housing 42 in the same way as the first positioning mechanism performs. In order to balance the IC package 30 on the housing 42 and assure uniform electrical engagement between the IC package 30 and the terminals 44, two pressing sections 626 of the third positioning mechanism are located symmetrical the top surface 32 of the IC package 30, e.g. middles of opposite sides of the top surface 32.

Figure 8:
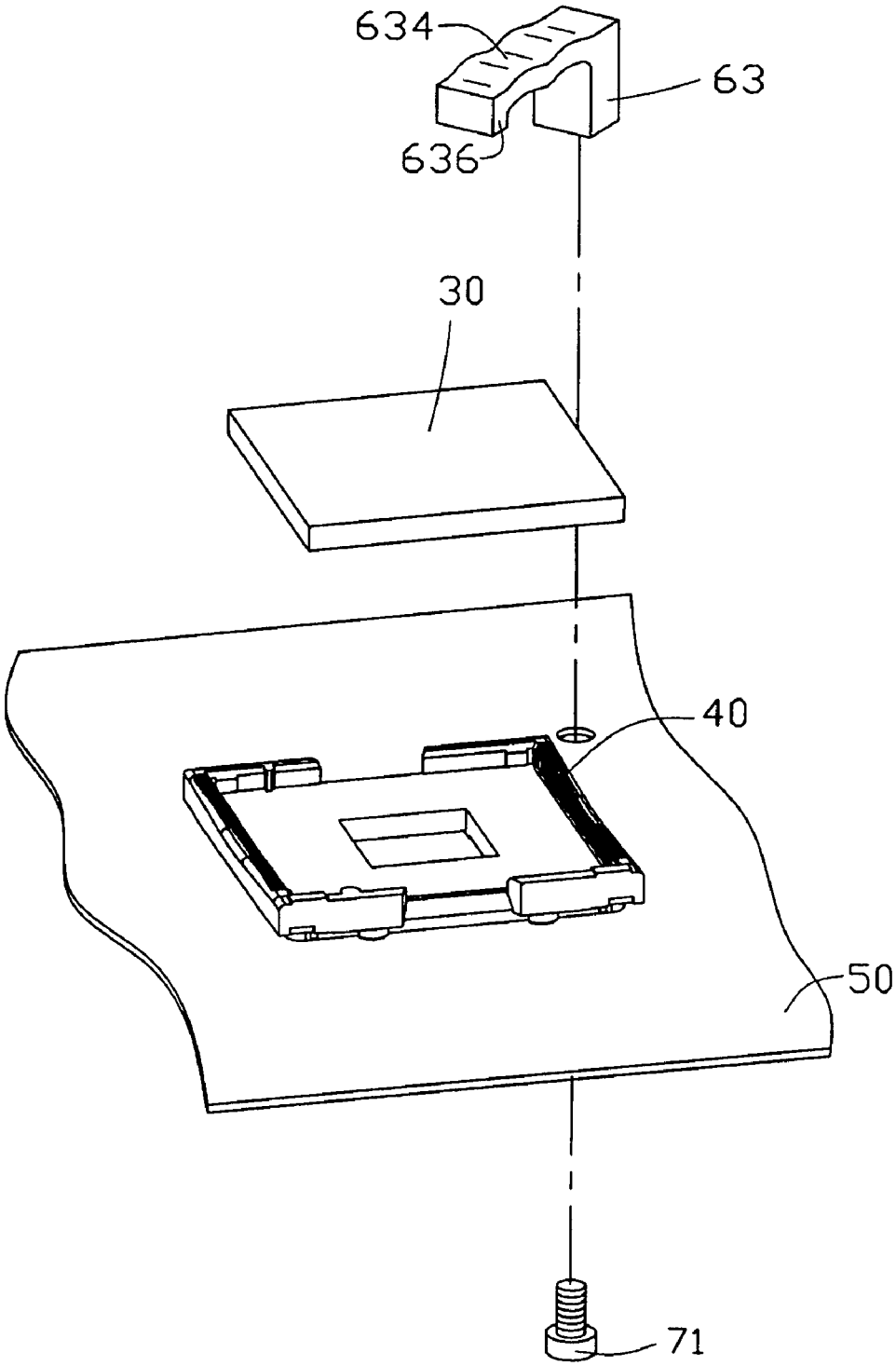
FIG. 8 is an exposed, isometric view of the LAG socket mounted on the PCB, together with a forth position mechanism according to a forth preferred embodiment of the present invention and the IC package ready to engage with the LGA socket.
Figure 9:
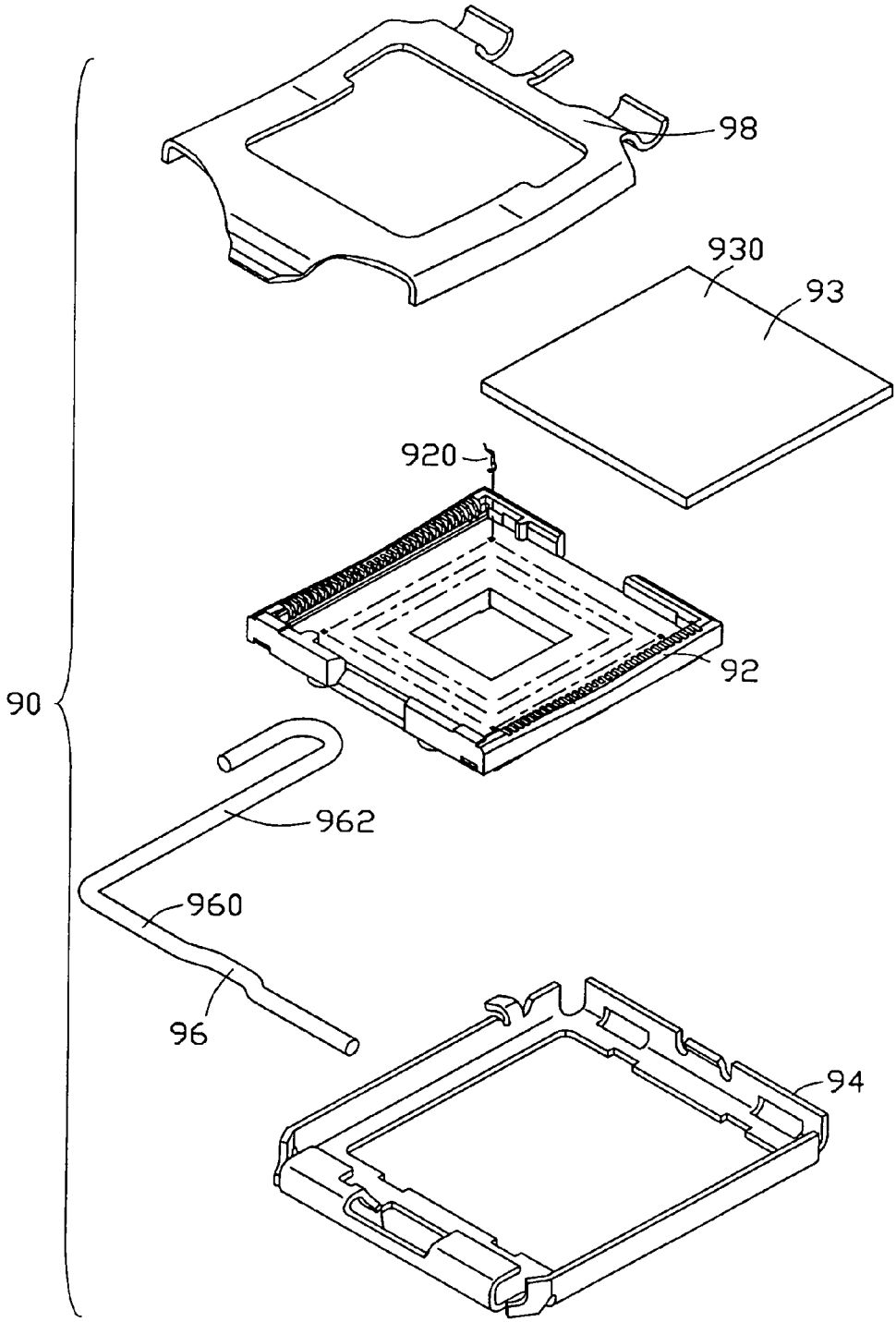
FIG. 9 (PRIOR ART)
FIG. 9 is an exposed, isometric view of an LGA socket assembly.
Figure 10:
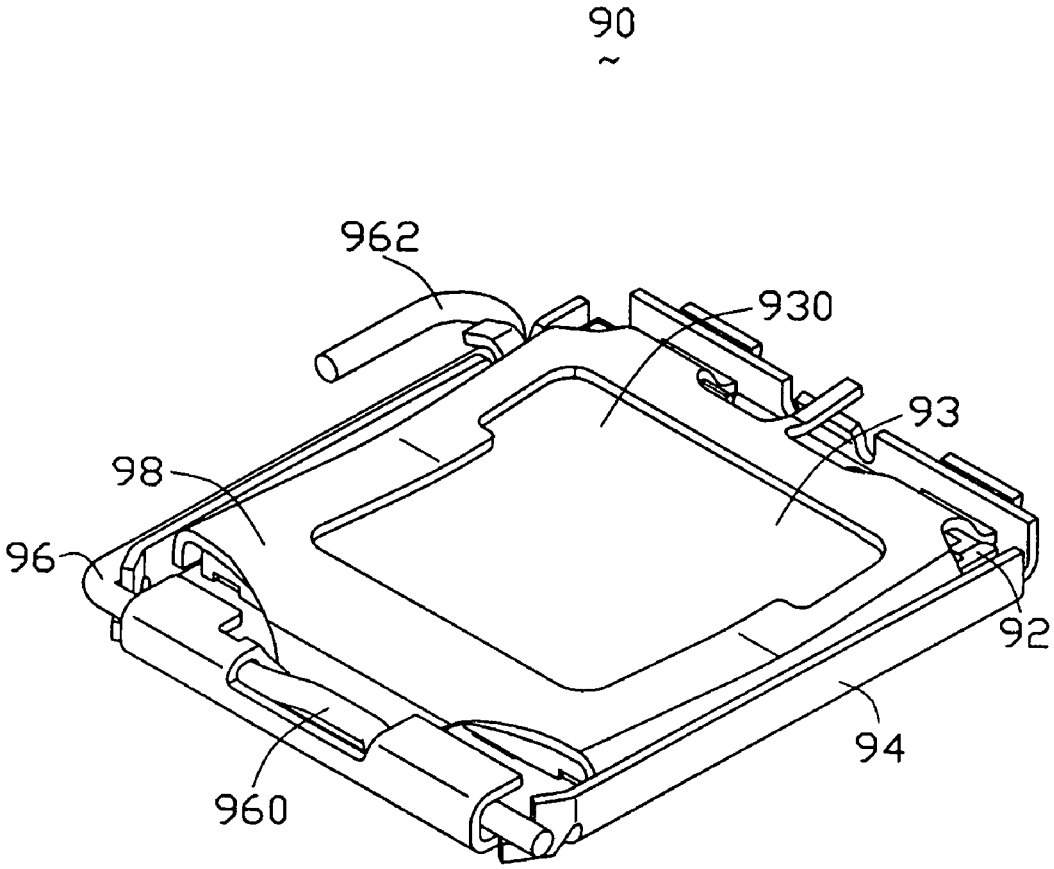
FIG. 10 (PRIOR ART)
FIG. 10 is an assembled, isometric view of FIG. 9.

Referring to FIG. 8, together with the LGA socket 40, the PCB 50 and the IC package 30 of FIG. 1, when more space is desired to be saved, only a single holding member 63 may be provided to hold the IC package 30 on the LGA socket 40 as shown in fourth embodiment. The pressing section 636 of the fourth positioning mechanism is disposed to press against a center of the top surface 32 of the IC package 30, thereby assuring uniform electrical engagement between the IC package 30 and the terminals 44.

It should be understood that the holding members 62, 63 of the third and fourth positioning mechanisms can be replaced by the holding member 61 of the second positioning mechanism.

Furthermore, although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. A fastening mechanism for an electrical connector mounted on a surface of an electrical substrate for electrically nesting an IC package by terminals planted on a housing of the electrical connector, the fastening mechanism comprising:

at least one holding unit, said at least one holding unit comprising a base portion being connected with the electrical substrate; a resilient arm extending from the base and being formed with a pressing head spaced a distance from the base portion, the head being formed with an engaging face able to be adjusted to move in a direction vertical to said surface and rotate round a axis vertical to said surface in order to hold the IC package on the housing, thereby establishing electrical engagement between the IC package and the electrical connector.

2. The fastening mechanism as claimed in claim 1, wherein the base portion defines a screw hole in a bottom surface, the electrical substrate defines a through hole corresponding to the screw hole, a screw is provided to be inserted through the through hole and couple with the screw hole, thereby adjusting the engaging face.

3. The fastening mechanism as claimed in claim 1, wherein the base portion defines a through channel, the electrical substrate defines a through hole corresponding to the through channel, a bolt is provided to be inserted through the through hole and the through channel and couple with a nut, thereby adjusting the engaging face.

4. The fastening mechanism as claimed in claim 1, wherein the resilient arm has a generally wave-like configuration.

5. The fastening mechanism as claimed in claim 4, wherein the pressing head is disposed parallel to the base portion and the engaging face is parallel to said surface.

6. An electrical assembly, the assembly comprising:

a printed circuit board;

an electrical socket mounted on the printed circuit board and comprising a dielectric housing defining top and bottom surfaces and passageways between the top and bottom surfaces and a plurality of conductive members received in corresponding passageways, each of the conductive members having a top engaging portion extended above the top surface for electrically mating with an IC package;

a fixing mechanism being connected with the printed circuit board and comprising a body and an arm being connected with the body and being formed with a mating portion;

wherein the mating portion can be adjusted to move in a direction vertical to the top surface of the housing and rotate round an axis vertical to the top surface of the housing in order to hold the IC package on the top engaging portions of the terminals.

7. The assembly as claimed in claim 6, wherein the body defines a screw hole in a bottom surface, the printed circuit board defines a through hole corresponding to the screw hole, a screw is provided to be inserted through the through hole and couple with the screw hole, thereby adjusting the mating portion.

8. The assembly as claimed in claim 6, wherein the body defines a through channel, the printed circuit board defines a through hole corresponding to the through channel, a bolt is provided to be inserted through the through hole and the through channel and couple with a nut, thereby adjusting the mating portion.

9. The assembly as claimed in claim 6, wherein the housing is formed with a substantially rectangular floor and four sidewalls raised from four edges of the floor, the floor and the sidewalls cooperatively defines a cavity above the passageways for receiving the IC package.

10. The assembly as claimed in claim 9, wherein the sidewalls each are formed with a slant surface at a top inner corner thereof for guidance of the IC package into the cavity.

11. The assembly as claimed in claim 10, wherein two opposite sidewalls each defines a recess substantially at a middle thereof for facilitating disposing or removing the IC package into or from the cavity.

12. The assembly as claimed in claim 10, wherein the sidewalls are formed to provide three protrusions extending into the cavity to position the IC package in a plane parallel to said top surface.

13. The assembly as claimed in claim 6, wherein the body has a substantially wave-like configuration.

14. The assembly as claimed in claim 13, wherein the mating portion of the fixing mechanism is disposed parallel to the body, the mating portion is formed with a compressing surface at a bottom thereof and being parallel to the top surface to hold a top face of the IC package.

15. An electrical connector assembly comprising:

printed circuit board having a mounting surface defining a connector area and fastener area surrounding said connector area;

an electrical connector mounted upon said connector area and including a plurality of contacts with contacting tips thereof;

an electronic component seated upon the connector;

at least one fastener located on the fastener area and defining a holding arm;

wherein said arm is moveable between a first position away from the connector area to allow the electronic component to be loaded unto the connector and a second position above said connector area to downwardly press the electronic component against the connector so as to not only make reliable mechanical and electrical engagement between the electronic component and the contacting tips but also hold said electronic component in position without upward withdrawal from the connector.

16. The connector as claimed in claim 15, wherein said contact exerts an upward force when said electronic component is downwardly pressed by said fastener.

17. The connector as claimed in claim 15, wherein said fastener is rotatable about an axis.

18. The connector as claimed in claim 17, wherein said axis is perpendicular to said printed circuit board.

* * * * *